US011224819B2

(12) United States Patent
Brister et al.

(10) Patent No.: US 11,224,819 B2
(45) Date of Patent: Jan. 18, 2022

(54) SYSTEMS AND METHODS FOR MANEUVERING A VEHICLE

(71) Applicant: Universal City Studios LLC, Universal City, CA (US)

(72) Inventors: Michael Keith Brister, Winter Garden, FL (US); Clarisse Marie Vamos, Orlando, FL (US); Michael Joseph Tresaugue, Windermere, FL (US)

(73) Assignee: Universal City Studios LLC, Universal City, CA (US)

( * ) Notice: Subject to any disclaimer, the term of this patent is extended or adjusted under 35 U.S.C. 154(b) by 435 days.

(21) Appl. No.: 16/251,916

(22) Filed: Jan. 18, 2019

(65) Prior Publication Data

US 2020/0215440 A1 Jul. 9, 2020

Related U.S. Application Data

(60) Provisional application No. 62/789,120, filed on Jan. 7, 2019.

(51) Int. Cl.

| | |
|---|---|
| ***A63G 21/08*** | (2006.01) |
| ***A63G 21/14*** | (2006.01) |
| ***A63G 21/20*** | (2006.01) |
| ***A63G 21/04*** | (2006.01) |
| *A63G 31/16* | (2006.01) |

(52) U.S. Cl.

CPC ..... *A63G 21/08* (2013.01); *A63G 21/04* (2013.01); *A63G 21/14* (2013.01); *A63G 21/20* (2013.01)

(58) Field of Classification Search

CPC . A63G 1/08; A63G 1/30; A63G 21/08; A63G 31/00

USPC ..... 472/43, 59, 60, 130; 434/55

See application file for complete search history.

(56) References Cited

U.S. PATENT DOCUMENTS

| | | | | |
|---|---|---|---|---|
| 1,712,353 | A | 5/1929 | Meling | |
| 3,930,450 | A | 1/1976 | Symons | |
| 5,403,238 | A | 4/1995 | Baxter et al. | |
| 5,623,878 | A | 4/1997 | Baxter et al. | |
| 6,533,670 | B1 | 3/2003 | Drobnis | |
| 7,717,798 | B2 * | 5/2010 | Bellows ..... | A47D 13/10 472/36 |

(Continued)

FOREIGN PATENT DOCUMENTS

| | | |
|---|---|---|
| FR | 598236 | 12/1925 |
| GB | 191418743 | 3/1915 |

OTHER PUBLICATIONS

PCT/US2020/012078 International Search Report and Written Opinion dated Mar. 25, 2020.

*Primary Examiner* — Kien T Nguyen
(74) *Attorney, Agent, or Firm* — Fletcher Yoder, P.C.

(57) ABSTRACT

An amusement park ride vehicle includes a chassis, a cabin, a slider, and a rotator. The chassis is configured to direct the ride vehicle along a ride path in a direction of travel. The cabin is configured to hold one or more passengers. The slider is configured to translate between a neutral position and a cantilevered position relative to the chassis in a direction substantially transverse to the direction of travel and to carry the rotator and the cabin along the direction substantially transverse to the direction of travel. The rotator is coupled between the slider and the cabin, and is configured to rotate the cabin relative to the slider.

18 Claims, 13 Drawing Sheets

(56) References Cited

U.S. PATENT DOCUMENTS

| | | | | |
|---|---|---|---|---|
| 8,678,940 | B2 * | 3/2014 | Willcox | A63G 1/30<br>472/33 |
| 10,525,361 | B2 | 1/2020 | Cummins et al. | |
| 2009/0272289 | A1 | 11/2009 | Baker et al. | |
| 2011/0067594 | A1 * | 3/2011 | Nemeth | A63G 21/08<br>104/76 |

* cited by examiner

SYSTEMS AND METHODS FOR MANEUVERING A VEHICLE

CROSS REFERENCE TO RELATED APPLICATION

This application claims benefit of U.S. Provisional Application Ser. No. 62/789,120, filed Jan. 7, 2019, entitled "Systems and Methods for Maneuvering a Vehicle," which is hereby incorporated by reference in its entirety for all purposes.

BACKGROUND

The present disclosure relates generally to amusement park-style rides, and more specifically to techniques for achieving particular movements or maneuvers of ride vehicles along a path.

Many amusement park-style rides include ride vehicles that carry guests along a ride path, such as a ride path defined by a track (e.g., a guide rail). Such traditional amusement park rides are subject to certain constraints. For example, vehicle maneuvers are limited by aspects of the ride systems. As a specific example, minimum turn radiuses along the path of a traditional system may restrict movement of a ride vehicle while passing along turns in the path. As another example, aspects of the ride vehicle (e.g., a turn radius of the ride vehicle) may prevent certain movements in conjunction with other traditional system components. Thus, it is now recognized that traditional ride systems can constrain maneuvers of ride vehicles and prevent the provision of desired user experiences.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

BRIEF DESCRIPTION

Certain embodiments commensurate in scope with the originally claimed subject matter are summarized below. These embodiments are not intended to limit the scope of the claimed subject matter, but rather these embodiments are intended only to provide a brief summary of possible forms of the subject matter. Indeed, the subject matter may encompass a variety of forms that may be similar to or different from the embodiments set forth below.

In an embodiment, an amusement park ride vehicle includes a chassis, a cabin, a slider, and a rotator. The chassis is configured to direct the ride vehicle along a ride path in a direction of travel. The cabin is configured to hold one or more passengers. The slider is configured to translate between a neutral and cantilevered position relative to the chassis in a direction substantially transverse to the direction of travel and to carry the rotator and the cabin along the direction substantially transverse to the direction of travel. The rotator is coupled between the slider and the cabin, and is configured to rotate the cabin relative to the slider.

In an embodiment, an amusement park ride system includes a guide rail and a ride vehicle. The guide rail defines a ride path and includes a bend that defines a turn. The ride vehicle includes a chassis, a slider, a cabin, and a rotator. The chassis is configured to couple to the guide rail and to direct the ride vehicle along the guide rail in a direction of travel. The slider is configured to laterally translate in a direction substantially transverse to the direction of travel and to carry the rotator and the cabin along the direction substantially transverse to the direction of travel. The cabin is configured to house one or more guests. The rotator is coupled between the slider and the cabin, and is configured to rotate the cabin relative to the slider.

A method includes directing a ride vehicle along a guide rail defining a ride path in a direction of travel toward a turn, actuating a slider to laterally actuate a cabin of the ride vehicle in a first linear direction substantially transverse to the direction of travel, from a neutral position toward a first side of the ride vehicle aligned with an outside of the turn, actuating a rotator to rotate the cabin of the ride vehicle in a first rotational direction opposite of a turn direction, wherein the rotator is disposed between the cabin and the slider, directing the ride vehicle along the guide rail in the direction of travel through the turn, actuating the slider to laterally actuate the cabin of the ride vehicle in a second linear direction, opposite the first linear direction, toward a central plane of the ride vehicle, returning the cabin to the neutral position, and actuating a rotator to rotate the cabin of the ride vehicle in a second rotational direction, opposite the first rotational direction.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
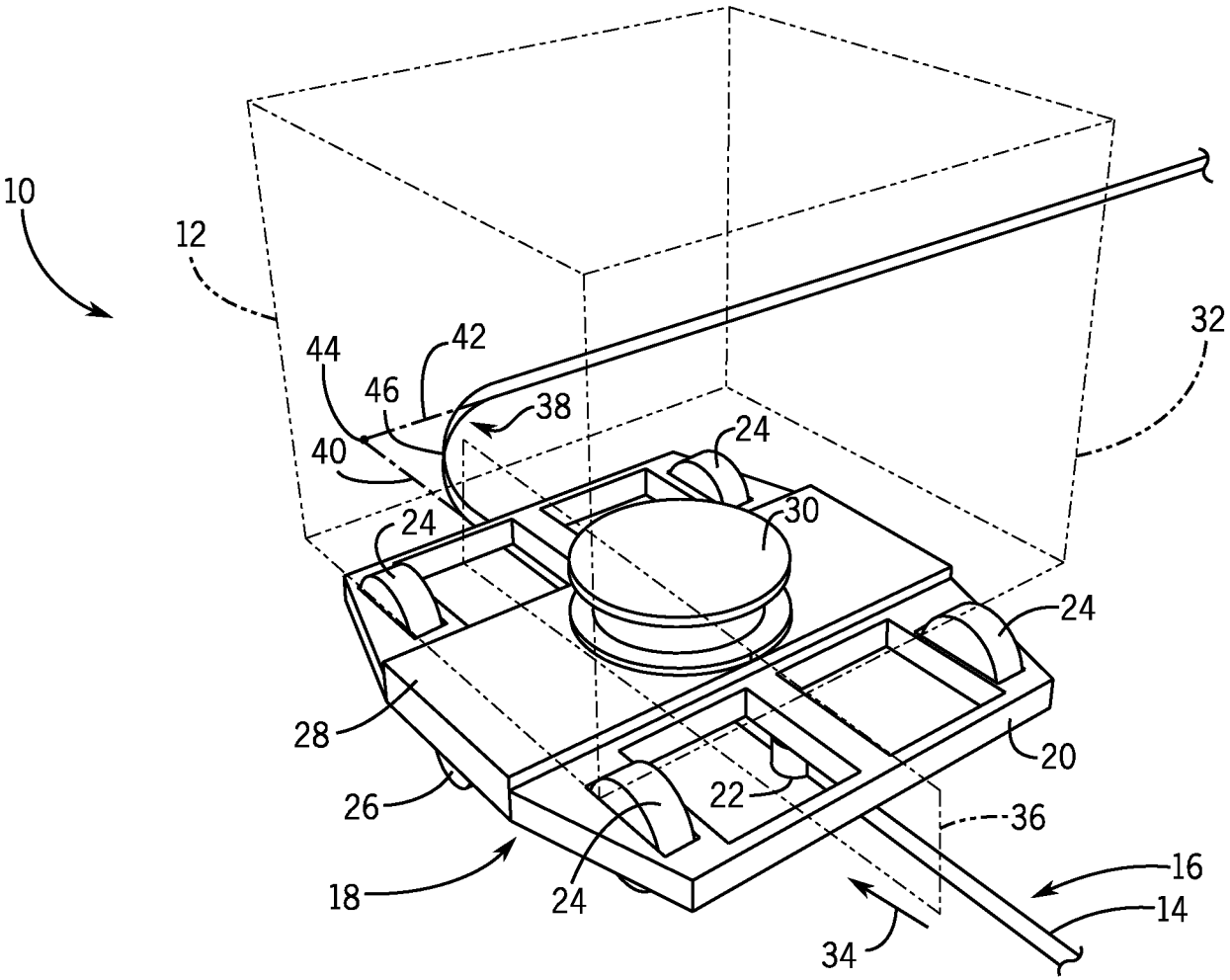
FIG. 1 is a perspective view of one embodiment of a ride vehicle of an amusement park ride system, in accordance with aspects of the present disclosure.

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Typical amusement park ride systems (e.g., roller coasters or other rides) include one or more ride vehicles that follow a guide rail through a series of features. Such features may include tunnels, turns, ascents, descents, loops, and the like. For some ride systems, a designer may wish for the ride passengers to experience the feeling of a sharp (e.g., 90 degree) turn. However, the geometry of the guide rail and the system that couples the ride vehicle to the guide rail may put a lower limit on the minimum turning and/or radius of the guide rail and the ride vehicle, which may feel to the passengers like a gradual turn as the ride vehicle traverses the turn. Similarly, in ride systems that do not use a guide rail but include ride vehicles that otherwise traverse a path, a wheel base of the vehicle, for example, may limit the turning radius. Accordingly, it may be desirable to make the user feel as though the turning radius is significantly smaller than the turning and/or radius of the guide rail that the ride vehicle traverses.

The presently disclosed embodiments include a ride vehicle having a cabin to house one or more guests, a chassis (e.g., a chassis that couples to a guide rail), and a slider and rotator disposed between the chassis and the cabin. Further, the presently disclosed embodiments may include a path (e.g., a guide rail) along which the ride vehicle travels. The slider moves the cabin back and forth in a lateral direction that is substantially transverse to the direction of travel along the path. The rotator rotates the cabin relative to the chassis. The components may be used in concert to create effects that would be difficult, inefficient, or expensive to create with a normal ride vehicle. For example, to simulate a sharp turn (e.g., a sharp 90 degree turn), the slider may extend from a neutral position toward the outside of the turn and the rotator may rotate from a neutral position toward the outside of the turn as the ride vehicle approaches the apex of the turn. As the ride vehicle passes through and departs the apex of the turn, the slider may retract back toward the neutral position turn and the rotator may rotate back toward the inside of the turn and toward the neutral position. However, the slider and rotator may be used individually or in concert to create other effects. The effects created in accordance with present embodiments are particularly noticeable when compared with traditional guide rail-based systems. Accordingly, while present embodiments may also be employed with other types of paths, the illustrated embodiments focus on guide rail-based embodiments.

FIG. 1 is a perspective view of an embodiment of a ride system 10. The ride system 10 may include one or more ride vehicles 12 that hold one or more passengers. In an embodiment, multiple ride vehicles 12 may be coupled together (e.g., by a linkage). The ride vehicle 12 travels along a guide rail 14 that defines a ride path 16. The guide rail 14 may be any surface on which the ride vehicle 12 travels. In an embodiment, the guide rail 14 may have a generally square or rectangular cross sectional shape, or may have a specific cross sectional shape designed to interface with the ride vehicle 12. However, in other embodiments, the guide rail 14 may be a slot, or some other body or combination of bodies configured to guide the direction of the ride vehicle 12. In the illustrated embodiment, the guide rail 14 does not bear the entirety of the weight of the ride vehicle 12. However, in other embodiments, the guide rail 14, like train tracks, may bear the entirety of the weight of the ride vehicle 12.

As shown in FIG. 1, the ride vehicle 12 includes a ride vehicle base 18 that interfaces with the guide rail 14. The ride vehicle base 18 may include, for example, a chassis 20, one or more pinch wheels 22, font and rear support wheels 24, slider support wheels 26, and a slider 28. The pinch wheels 22 are configured to interface with the guide rail 14 such that the ride vehicle 12 travels along the guide rail 14. In the illustrated embodiment, the pinch wheels 22 do not bear the entirety of the weight of the ride vehicle 12. Instead, the pinch wheels 22 merely ensure that the ride vehicle 12 follows the ride path 16 defined by the guide rail 14. However, in other embodiments, the pinch wheels 22 may bear some or all of the weight of the ride vehicle 12.

In the illustrated embodiment, the front and rear support wheels 24 bear some or all of the weight of the ride vehicle between the two front and two rear support wheels 24. Though the illustrated embodiment includes a pair of front support wheels 24 and a pair of rear support wheels 24, in other embodiments there may be fewer support wheels 24 or more support wheels 24. For example, the ride vehicle base 18 may include 2, 3, 5, 6, 7, 8, 9, 10, or more front and rear support wheels 24. In some embodiments, some or all of the front and rear support wheels 24 may be driven wheels that rotate to propel the ride vehicle 12 along the ride path 16. For example, some or all of the front and rear support wheels 24 may include or be coupled to a drive mechanism that may apply a torque or some other propelling force to some or all of the front and rear support wheels 24 to propel the ride vehicle 12 along the ride path 16.

As is described in more detail below, the slider 28 may be configured to laterally move a cabin 32 in a direction substantially transverse to a direction of travel 34 of the ride vehicle 12. As such, the ride vehicle base 18 may include slider support wheels 26 that are configured to provide support for the slider 28 and the cabin 32 when the slider 28 is in an extended or partially extended position and the center of mass of the cabin 32 is cantilevered outward relative to a central plane 36 of the chassis 20, which extends along the direction of travel 34. In the illustrated embodiment, the slider support wheels 26 do not provide a propulsive force, however, in other embodiments, the slider support wheels 26 may include or be coupled to a drive mechanism.

The slider 28 may be configured to laterally move the cabin 32 in a direction substantially transverse to the direction of travel 34 of the ride vehicle 12 in order to simulate a sharp turn. As shown and described with regard to FIG. 5-11, the slider 28 may include, for example, a track extending in a direction substantially transverse to the direction of travel 34 of the ride vehicle 12, and a carriage configured to travel along the track and support a rotator 30 and the cabin 32. In some embodiments, the slider 28 may include a counterweight configured to move opposite the carriage to reduce or eliminate a moment created by the carriage as it moves along the track to a non-neutral position (e.g., when the center of mass of the cabin 32 is cantilevered outward relative to a central plane 36 of the chassis 20). In other embodiments, the slider 28 may include two plates that extend substantially parallel to one another and are configured to move relative one another along substantially parallel planes. In such an embodiment, the slider 28 may include a counterweight. For example, one of the plates may be coupled to the rotator 30 and the cabin 32 and the second plate may act as a counterweight or be coupled to the counterweight. In further embodiments, the slider 28 may include one or more springs and/or dampers. Additional embodiments of the slider 28 are also envisaged.

The rotator 30 may be disposed between the slider 28 and the cabin 32 and is configured to allow the cabin 32 to rotate relative to the slider 28. For example, the rotator 30 may be coupled to the slider 28 on a first side and coupled to the cabin 32 on a second side. As shown and described below with regard to FIG. 12, the rotator 30 may include, for example, first and second plates configured to rotate relative to one another. In some embodiments, the rotator 30 may include a bearing and/or a rotational actuator disposed between the two plates. In some embodiments, the first and second plates may remain substantially parallel to one another. In other embodiments, the rotator 30 may be capable of tilting the cabin 32 in addition to rotating the cabin 32 (e.g., to simulate a banked or cambered turn). For example, the rotator 30 may include a motion base with a desired number of degrees of freedom.

The cabin 32 may be supported by the rotator 30 and configured to rotate with the rotator 30. For the sake of simplicity, the cabin 32 is represented by a transparent box in FIG. 1. However, the cabin 32 may be any compartment configured to house guests. As such, it should be understood that the shape of the cabin 32 is not limited to a cube or rectangular prism. Further, the cabin 32 may include a framework that acts as structural support for the cabin 32. The cabin 32 may also include panels or siding that couples to the framework to close in the cabin 32. As such, the cabin 32 may be open or closed. The cabin 32 may include seats or places on which guests may sit. In some embodiments, the cabin 32 may also include restraint systems to hold guests in place as the cabin 32 makes movements. In other embodiments, guests may be free to stand or move about within the cabin 32.

In some cases, an operator of the ride system 10 may wish to create the effect of the ride vehicle 12 making a sharp (e.g., 90 degree) turn. However, the ride system 10 may have certain limitations that prevent the ride vehicle base 18 from making a sharp turn. For example, the guide rail 14 may have a minimum bend radius or a minimum radius of the guide rail 14 that the ride vehicle 12 can traverse. In other embodiments, the ride vehicle 12 may have a minimum turning radius (e.g., due to the geometry of the chassis 20, the pinch wheels 22, the front and rear support wheels 24, the slider support wheels 26, other components, or some combination thereof). As such, the slider 28 and the rotator 30 may actuate in concert such that the cabin 32 makes a sharp turn while the ride vehicle base 18 makes a more gradual turn along the guide rail 14. Riders in the cabin 32 will traverse a path that includes a substantially 90 degree turn and feel as though the entire ride vehicle 12 is making such a turn. Thus, maneuvers can be simulated that are not actually occurring for each feature of the ride vehicle 12 (e.g., the ride vehicle base 18).

As shown in FIG. 1, where the ride vehicle 12 is going to make a turn as it progresses in the direction of travel 34, the guide rail 14 includes a bend 38 having a bend radius. FIG. 1 includes a first line 40 that substantially aligns with the guide rail 14 before the bend 38 and a second line 42 that substantially aligns with the guide rail 14 after the bend 38. The first line 40 and the second line 42 intersect with one another at a point 44. In the illustrated embodiment, the first line 40 and the second line 42 are perpendicular to one another (e.g., the first line 40 and the second line 42 intersect with one another at a 90 degree angle). However, it should be understood that in other embodiments, the first line 40 and the second line 42 may intersect one another at an oblique angle or some other angle. For example, the turn may have an angle of 10, 20, 30, 40, 50, 60, 70, 80, 100, 110, 120, 130, 140, 150, 160, 170 degrees, or some other value. For example, as the ride vehicle base 18 travels along the guide rail 14 through the bend 38 toward an apex 46 of the turn, the slider 28 extends toward the outside of the bend 38 and the rotator 30 rotates opposite the direction of the turn such that the cabin continues to travel along the first line 40 toward the point 44 as the guide rail 14 diverges from the first line 40. In some embodiments, the rotator 30 may rotate the cabin 32 the same number of degrees as the turn (e.g., 90 degrees) to simulate a sharp turn. In other embodiments, upon reaching the point 44, the cabin 32 may shift directions without rotating. As the ride vehicle base 18 proceeds along the guide rail 14, past the apex 46 of the bend 38, the rotator 30 rotates in the direction of the turn and the slider 28 contracts toward the inside of the bend 38, to the neutral position, such that the cabin 32 travels along the second line 42 away from the point 44 as the guide rail 14 converges with the second line 42.

Figure 2:
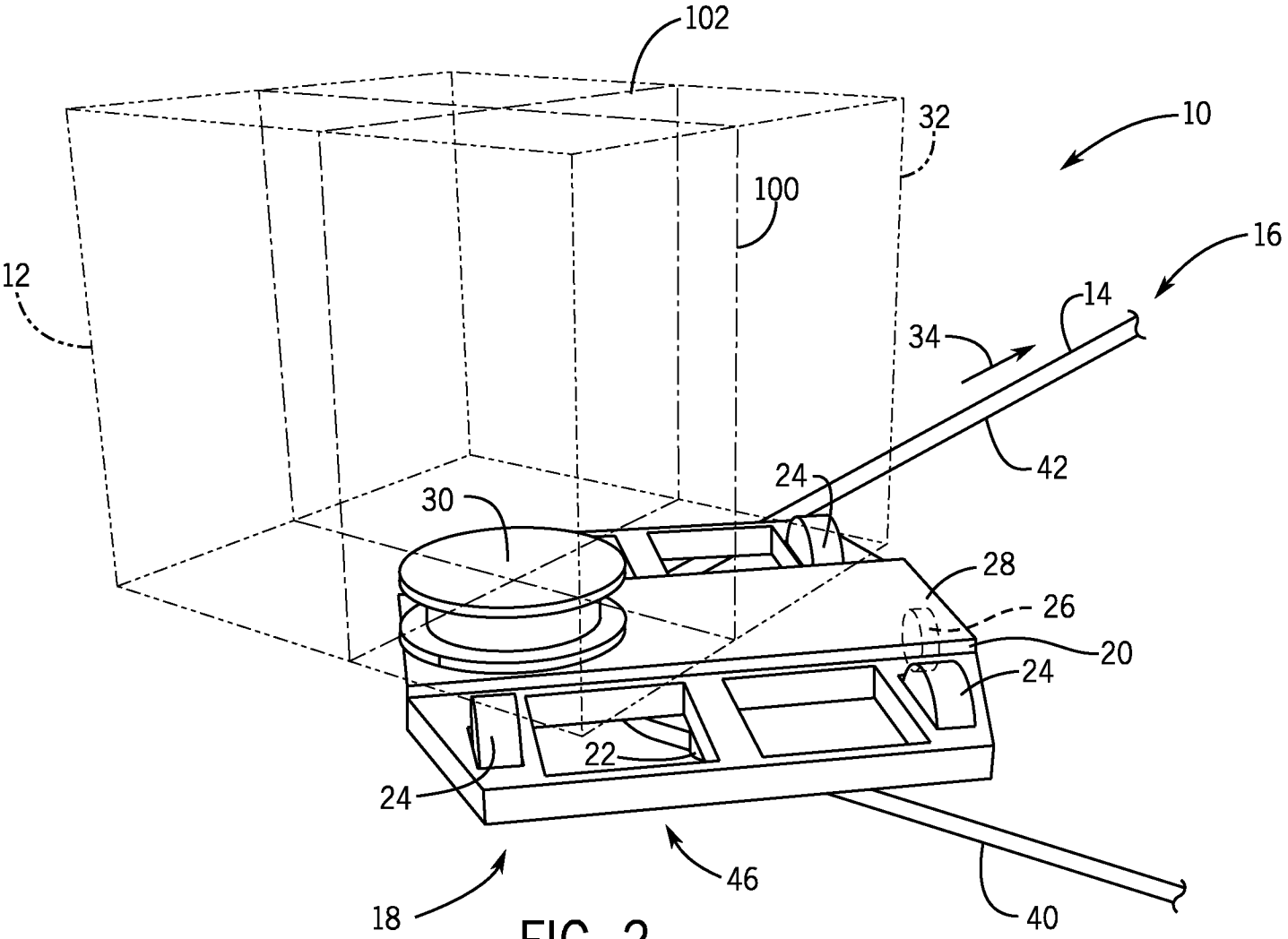
FIG. 2 is a perspective view of the ride vehicle of the amusement park ride system of FIG. 1, at an apex of a turn, in accordance with aspects of the present disclosure.

FIG. 2 is a perspective view of the ride vehicle 12 at the apex 46 of the turn. As shown, the slider 28 is extended toward the outside of the turn and the rotator 30 is rotated such that a first central plane 100 of the cabin 32 is substantially aligned with the first line 40. Upon reaching the apex 46 of the turn, the rotator 30 may rotate such that the first central plane 100 is substantially aligned with the second line 42. In other embodiments, the ride vehicle 12 may proceed along the guide rail 14 such that a second central plane 102 of the cabin 32 is substantially aligned with the second line 42. If the turn is not a 90 degree turn, the rotator 30 may rotate at or near the apex 46 such that the first central plane 100, the second central plane 102, or neither central plane, is substantially aligned with the second line 42. As the ride vehicle 12 proceeds through the turn, away from the apex 46, the slider 28 may retract, sliding back to the neutral position and the rotator 30 may rotate such that either the first central plane 100 or the second central plane 102 is substantially aligned with the second line 42. In the illustrated embodiment, the first central plane 100 and the second central plane 102 each respectively bisect the cabin 32 and one another such that the first central plane 100 and the second central plane 102 define quarters of the cabin 32.

Figure 3:
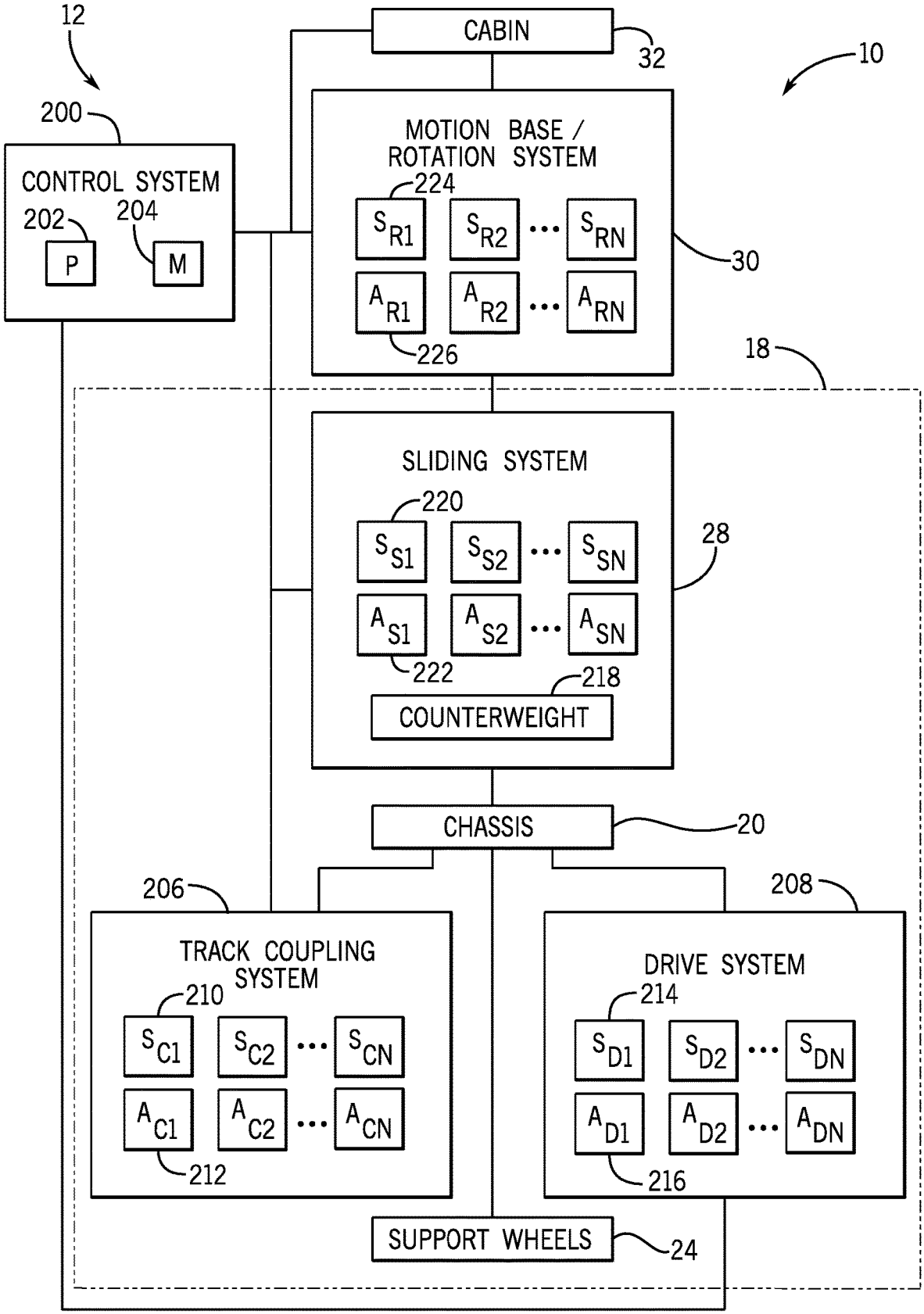
FIG. 3 is a schematic of a control system for the ride vehicle of FIGS. 1 and 2, in accordance with aspects of the present disclosure.

FIG. 3 is a schematic of a control system 200 for the ride vehicle 12. The control system 200 may include a processor 202 and a memory component 204, which may control and/or receive inputs from various components throughout the ride system 10. The processor 202 may be used to run programs, execute instructions, interpret inputs, generate control signals, and/or other similar functions. The memory component 204 may be used to store data, programs, instructions, and so forth.

The control system 200 may be in communication with various components of ride vehicle 12, such as the cabin 32, the rotator 30, the slider 28, a guide rail coupling system 206, a drive system 208, and or other components of the ride vehicle 12. In some embodiments, the control system 200 may also be in communication (e.g., wired or wireless) with a control system for the entire ride system 10. As shown, and discussed in more detail below, each of the rotator 30, the slider 28, the guide rail coupling system 206, and a drive system 208 may include sensors and actuators that may be in communication with the control system 200. The control system 200 may receive data from the sensors and/or actuators, process the data, and output control signals to the actuators to actuate various aspects of the rotator 30, the slider 28, the guide rail coupling system 206, the drive system 208, and so forth.

For example, the guide rail coupling system 206 (which may include, among other components, the pinch wheels 22 shown in FIGS. 1 and 2), may include one or more sensors 210 and/or one or more actuators 212 for coupling and decoupling the ride vehicle 12 to the guide rail. For example, the sensors 210 may include proximity sensors, laser sensors, and so forth for determining the position of the guide rail relative to the ride vehicle 12, the presence of the guide rail, the position of the actuators 212, etc. The actuators 212 may include one or more servos, one or more linear motors, and/or one or more clamping mechanisms for coupling and decoupling the ride vehicle 12 to and from the guide rail. The sensors 210 may sense one or more parameters of interest and provide data to the control system 200. The control system 200 may then process the data and generate a control signal that is sent to the one or more actuators 212. The actuators 212 may then actuate in response to the control signal.

The drive system 208 (which may include, among other components, the front and/or rear support wheels 24 shown in FIGS. 1 and 2), may include one or more sensors 214 and/or one or more actuators 216 propelling the ride vehicle 12 along the guide rail. For example, the sensors 214 may include position sensors, speed sensors, acceleration sensors, and so forth for determining one or more parameters relative to the movement of the ride vehicle 12, the position of the actuators 216, etc. The actuators 216 may include an electric motor, a combustion engine, one or more magnetic actuators, etc. for propelling the ride vehicle 12 along the guide rail. Though not shown, the drive system 208 may include a power source (combustion engine, generator, battery, hydraulic or pneumatic accumulator, electric utilities source) or a connection to a power source. The sensors 214 may sense one or more parameters of interest and provide data to the control system 200. The control system 200 may then process the data and generate a control signal that is sent to the one or more actuators 216. The actuators 216 may then actuate in response to the control signal.

The sliding system (e.g., the slider 28), as previously described, may include a carriage configured to move along a track, two plates configured to move relative to one another along substantially parallel planes, or some other configuration that allows the cabin 32 to move laterally from a neutral position toward an edge of the chassis 20. Some embodiments of the sliding system 28 may include a counterweight 218 to offset the moment created by movement of the sliding system 28 by moving opposite the cabin 32. Further, the sliding system 28 may include one or more sensors 220 and/or one or more actuators 222 to actuate the sliding system 28. For example, the sensors 220 may include sensors for sensing a position of the slider 28, a position of the cabin 32, a position of the ride vehicle 12, or some other measurable parameter. The actuators 222 may include a linear motor, a servo, or some other actuator for actuating the slider 28 to achieve lateral movement of the cabin 32. However, in some embodiments, the slider 28 may not include actuators and may rely on the momentum and/or centrifugal force to move the slider 28. The sensors 220 may sense one or more parameters of interest and provide data to the control system 200. The control system 200 may then process the data and generate a control signal that is sent to the one or more actuators 222. The actuators 222 may then actuate in response to the control signal.

The rotation system (e.g., the rotator 30), as previously described, may include a bearing and/or a rotational actuator disposed between the two plates, a motion base, or some other configuration that allows the cabin 32 to rotate about an axis. Some embodiments of the rotator 30 may also tilt the cabin 32 in one or more directions (e.g., to simulate a banked or cambered turn). The rotation system 30 may include one or more sensors 224 and/or one or more actuators 226 to actuate the rotation system 30. For example, the sensors 224 may include sensors for sensing a position of the rotator 30, a position of the cabin 32, a position of the ride vehicle 12, or some other measurable parameter. The actuators 226 may include a linear motor, a servo, or some other actuator for actuating the rotation system 30 to achieve rotational movement of the cabin 32. The sensors 224 may sense one or more parameters of interest and provide data to the control system 200. The control system 200 may then process the data and generate a control signal that is sent to the one or more actuators 226. The actuators 226 may then actuate in response to the control signal.

Figure 4:
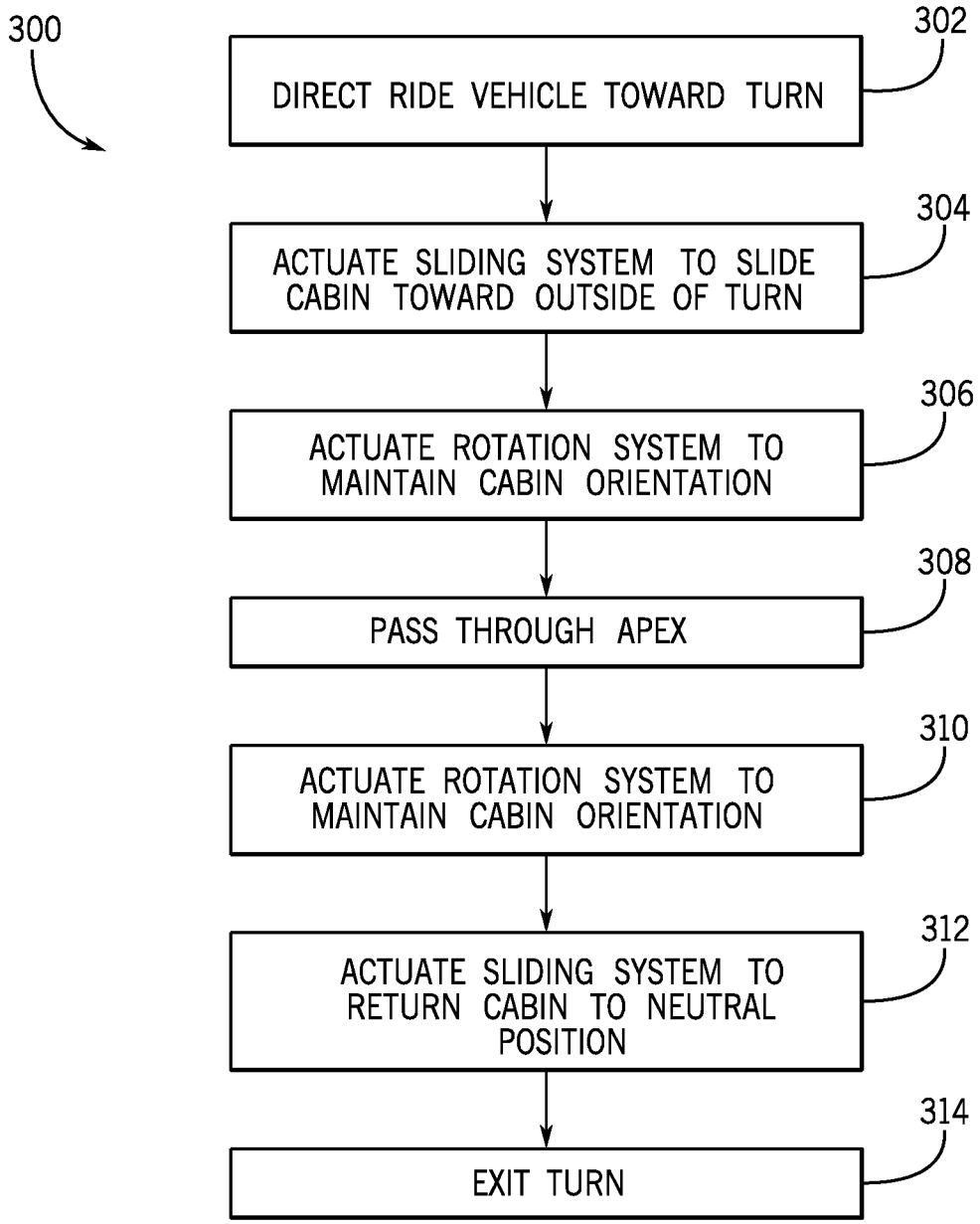
FIG. 4 is a flow chart of a process for simulating a sharp turn with the ride vehicle, in accordance with aspects of the present disclosure.

FIG. 4 is a flow chart of a process 300 for simulating a sharp (e.g., 90 degree) turn, where first and second lines intersect, with a vehicle having a limited turning radius. At block 302, the ride vehicle is directed along a guide rail and/or ride path substantially aligned with the first line toward the turn. At block 304, as the guide rail and/or ride path diverges from the first line, the sliding system is actuated to laterally move the cabin toward the outside of the turn. In some embodiments, the slider may actuate such that the central plane of the cabin remains substantially aligned with the first line. As the sliding system actuates, the rotation system may also actuate (block 306) opposite the direction of the turn such that the central plane of the cabin continues to be substantially aligned with the first line as the ride vehicle travels along the guide rail and/or ride path.

At block 308, the ride vehicle passes through the apex of the turn. At block 310, the rotation system continues to actuate opposite the direction of the turn such that the cabin may shift directions without changing its orientation. In other embodiments, the rotation system actuates to rotate the cabin the same number of degrees as the turn (e.g., 90 degrees) to simulate a sharp turn. As the ride vehicle proceeds along the ride path or guide rail, past the apex of the turn, the rotator may rotate in the direction of the turn such that the central plane of the cabin remains substantially aligned with the second line. As the rotation system actuates, the slider may contract toward the inside of the bend, to the neutral position (block 312), and such that the central plane of the cabin remains substantially aligned with the second line. At block 314, the ride vehicle exits the turn.

Figure 5:
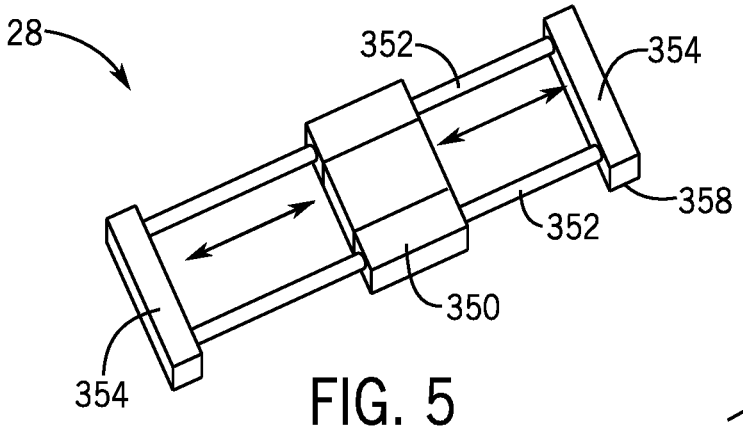
FIG. 5 is a perspective view of a slider of the ride vehicle of FIG. 3, including a carriage that moves along parallel rails, in accordance with aspects of the present disclosure.

FIGS. 5-12 illustrate various embodiments of the slider 28 and the rotator 30. FIG. 5 is a perspective view of the slider 28, including a carriage 350 that moves along a pair of substantially parallel rails 352. As shown, the rails 352 may be coupled to one another, and held in place, by first and second end caps 354 disposed at either end of each rail 352. The rails 352 and the end caps 354 may combine to form a slider body 358. The slider body 358 may or may not be a part of the chassis. As previously described, the carriage 350 may move back and forth along the rails 352 to move the cabin relative to the chassis. In some embodiments, the end caps 354 may act as mechanical stops for the carriage 350.

Figure 6:
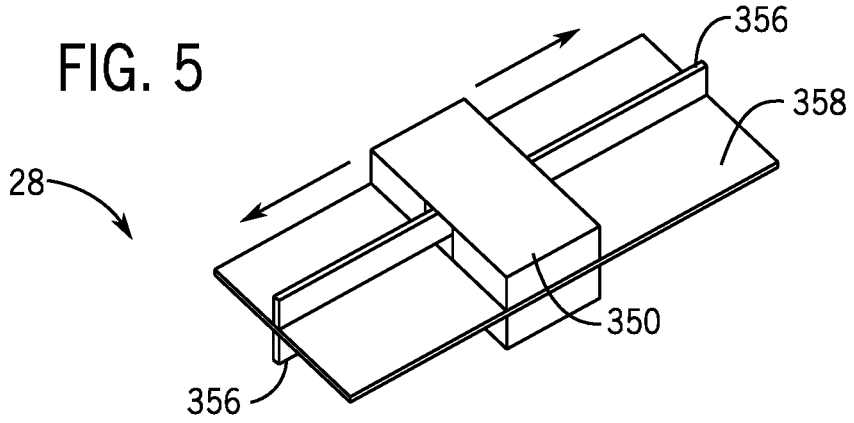
FIG. 6 is a perspective view of the slider of the ride vehicle of FIG. 1 including the carriage that moves along one or more features of a slider body, in accordance with aspects of the present disclosure.

FIG. 6 is a perspective view of the slider 28, including the carriage 350 that moves along one or more features 356 of the slider body 358. The slider body 358 may be a length of material (e.g., extruded, molded, cast, etc.) having the one or more features 356 that extend along part of or an entire length of the slider body 358 to which the carriage 350 couples. Though the embodiment of FIG. 6 shows a raised feature 356, the feature 356 may be a recessed feature. Similarly, though the embodiment of FIG. 6 shows a single feature 356, the one or more features 356 should be understood to include multiple features 356. As previously described, the carriage 350 may move back and forth along the one or more features 356 to move the cabin relative to the chassis.

Figure 7:
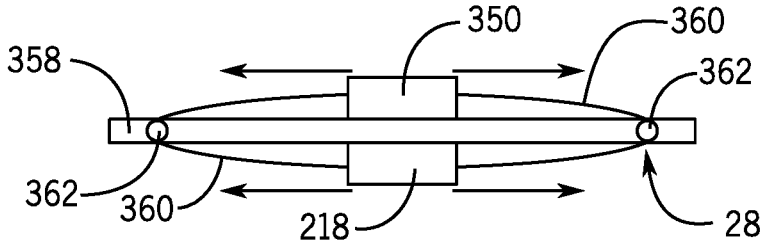
FIG. 7 is a side view of the slider of the ride vehicle of FIG. 1, including a counterweight, with the carriage at a neutral position, in accordance with aspects of the present disclosure.

FIG. 7 is a side view of the slider 28, including the counterweight 218, with the carriage 350 at the neutral position. As previously described, the counterweight 218 may be configured to move opposite the carriage 350 along the slider body 358 as the carriage 350 leaves the neutral position to counteract the cantilever effect caused by movement of the carriage 350. In the instant embodiment, the counterweight 218 is coupled to the carriage 350 via one or more couplings 360. The couplings 360 may include, for example, cables, belts, mechanical linkages, etc. In some embodiments, the couplings 360 may extend around one or more pulleys 362 to reduce friction associated with movement of the carriage 350 and the counterweight 218. However, it should be understood that in some embodiments, the carriage 350 and the counterweight 218 may not be coupled to one another. For example, the carriage 350 and the counterweight 218 may each be actuated by one or more actuators. In FIG. 7, the carriage 350 is shown in the neutral position, centered along the length of the slider body 358 and aligned directly above the counterweight 218.

Figure 8:
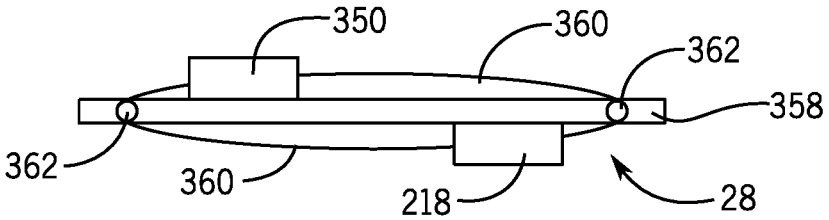
FIG. 8 is a side view of the slider of FIG. 7, with the carriage out of the neutral position, in accordance with aspects of the present disclosure.

FIG. 8 is a side view of the slider 28, including the counterweight 218, with the carriage 350 out of the neutral position. As shown, as the carriage 350 moves to the left, the counterweight 218 moves to the right to offset the cantilever effect created by movement of the carriage 350. When the carriage 350 returns to the neutral position, so too does the counterweight 218. Similarly, as the carriage 350 moves to the right, the counterweight 218 moves to the left to offset the cantilever effect created by movement of the carriage 350.

Figure 9:
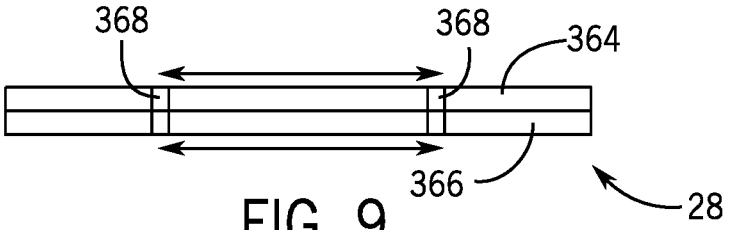
FIG. 9 is a side view of the slider of the ride vehicle of FIG. 1, including first and second plates, at the neutral position, in accordance with aspects of the present disclosure.

FIG. 9 is a side view of the slider 28, including first and second plates 364, 366, at the neutral position. In the illustrated embodiment, the second plate 366 may act as the counterweight and may be configured to move opposite the first plate 364 as the first plate 364 moves out of the neutral position to counteract the cantilever effect caused by movement of the first plate 364. The first and second plates 364 may be coupled to one another via one or more brackets 368.

Figure 10:
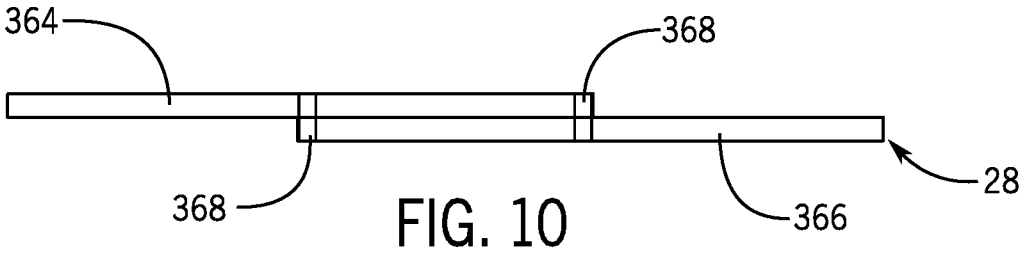
FIG. 10 is a side view of the slider of FIG. 9, including the first and second plates, out of the neutral position, in accordance with aspects of the present disclosure.

FIG. 10 is a side view of the slider 28, including first and second plates 364, 366, out of the neutral position. As shown, as the first plate 364 moves to the left, the second plate 366 moves to the right to offset the cantilever effect created by movement of the first plate 364. When the first plate 364 returns to the neutral position, so too does the second plate 366. Similarly, as the first plate 364 moves to the right, the second plate 366 moves to the left to offset the cantilever effect created by movement of the first plate 364.

Figure 11:
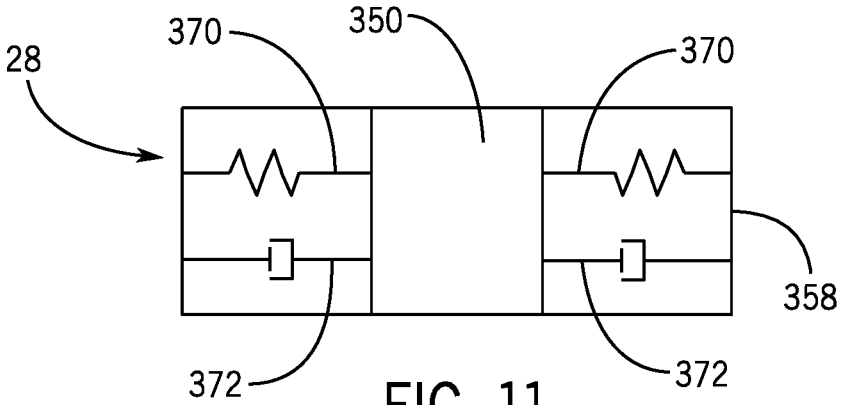
FIG. 11 is a schematic view of the slider of the ride vehicle of FIG. 1, including springs and dampers, in accordance with aspects of the present disclosure.

FIG. 11 is a schematic view of the slider 28, including springs 370 and dampers 372. In some embodiments one or more springs 370 and/or one or more dampers 372 may be used to tune the movement of the slider 28. For example, in some embodiments, the slider 28 may not be actuated and may rely on momentum and/or centrifugal force to translate from the neutral position to one side or the other. In such an embodiment, the slider may be designed with the one or more springs 370 and/or one or more dampers 372 in order to achieve the desired movement of the slider 28 in turns. However, in some embodiments, springs 370 and/or dampers 372 may be used in conjunction with actuators to tune movement of the slider 28.

Figure 12:
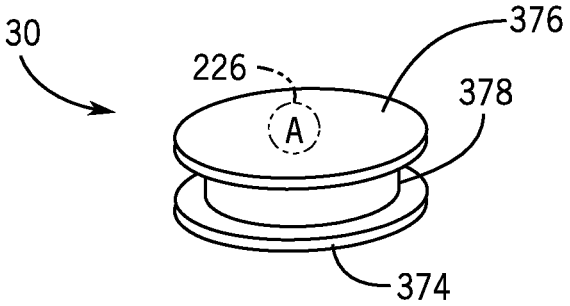
FIG. 12 is a perspective view of an embodiment of a rotator of the ride vehicle of FIG. 1, in accordance with aspects of the present disclosure.

FIG. 12 is a perspective view of an embodiment of the rotator 30. As illustrated, the rotator 30 may include a first plate 374, which may be coupled to the slider, and a second plate 376, which may be coupled to the cabin. The first and second plates 374, 376 may be coupled to one another via a bearing 378 that allows the first and second plates 374, 376 to rotate relative to one another with reduced friction. In some embodiments, the rotator 30 may include an actuator 226 (e.g., a servo, a rotary motor, a linear motor, etc.) configured to rotate the second plate 376 relative to the first plate 374, or rotate the first plate 374 relative to the second plate 376.

Figure 13:
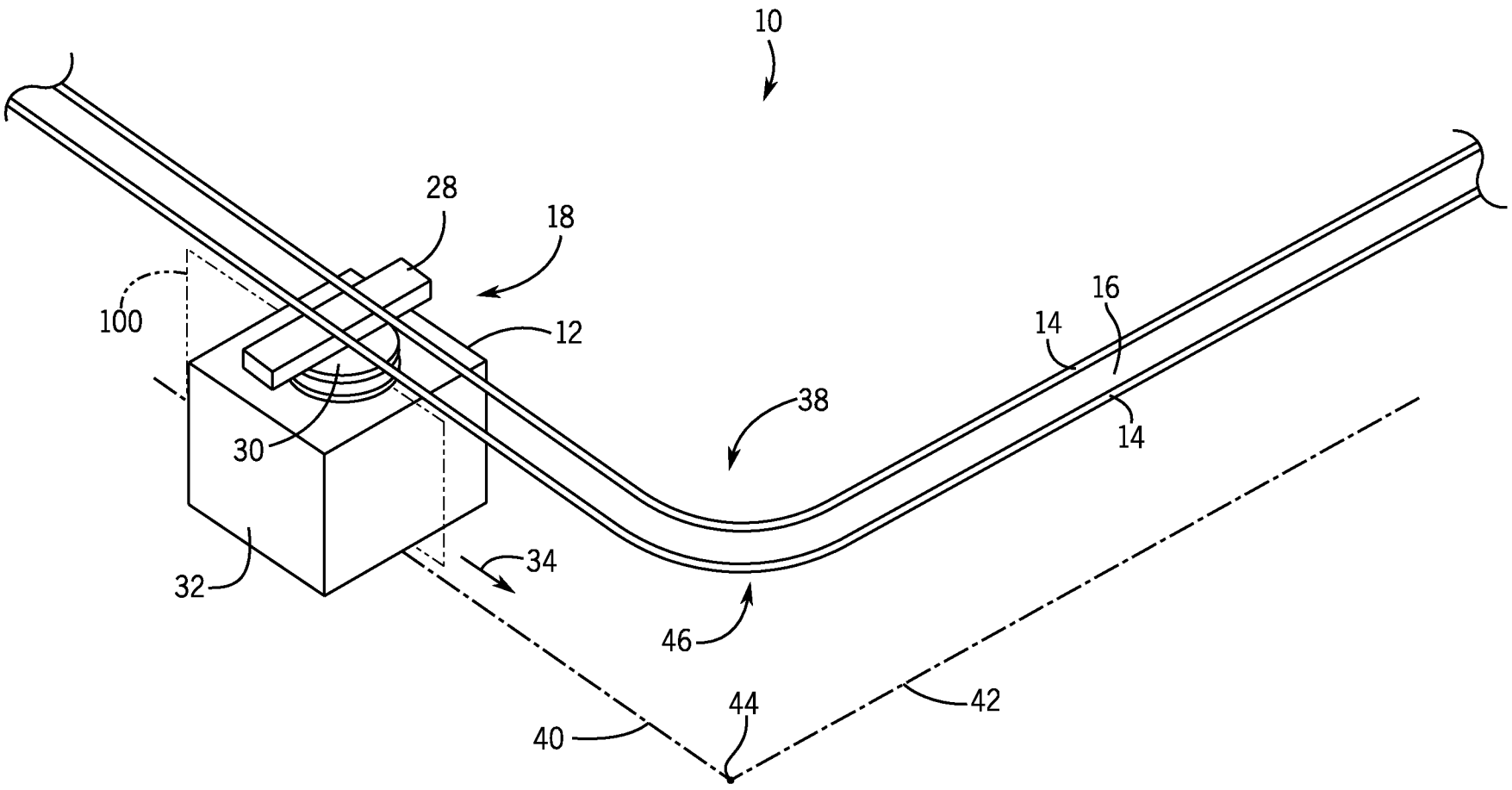
FIG. 13 is a perspective view of an embodiment of the ride vehicle as the ride vehicle approaches a bend in first and second guide rails, in accordance with aspects of the present disclosure.

It should be understood that, though FIGS. 1 and 2 show the ride vehicle sitting on top of, and traveling along, a single guide rail, other embodiments are envisaged. For example, FIGS. 13-19 illustrate an embodiment in which a ride vehicle is suspended beneath two guide rails. FIG. 13 is a perspective view of an embodiment of the ride vehicle system 10 as the ride vehicle 12 approaches the bend 38 in the guide rails 14. In the instant embodiment, the ride path 16 is defined by first and second guide rails 14, which extend substantially parallel to one another. As with previously described embodiments, the ride vehicle 12 is coupled to the guide rails 14 via the ride vehicle base 18, which may include the guide rail coupling system 206 shown in FIG. 3. However, in the instant embodiment, the ride vehicle base 18 is suspended beneath the guide rails 14 rather than sitting on top of the guide rails 14. The slider 28 is configured to laterally translate the rotator 30 and the cabin 32 in a direction substantially perpendicular to the direction of travel 34 along the guide rails 14. The rotator 30 is coupled to the slider 28 and is configured to rotate the cabin 32 relative to the ride vehicle base 18. In some embodiments, the rotator 30 may also be capable of tilting the cabin 32 relative to the ride vehicle base 18 (e.g., to simulate a banked or cambered turn). As shown in FIG. 13, as the ride vehicle 12 approaches the bend 38 in the guide rails 14, the slider 28 and the rotator 30 are in neutral positions such that the central plane 100 of the cabin 32 is substantially aligned with the first line 40.

Figure 14:
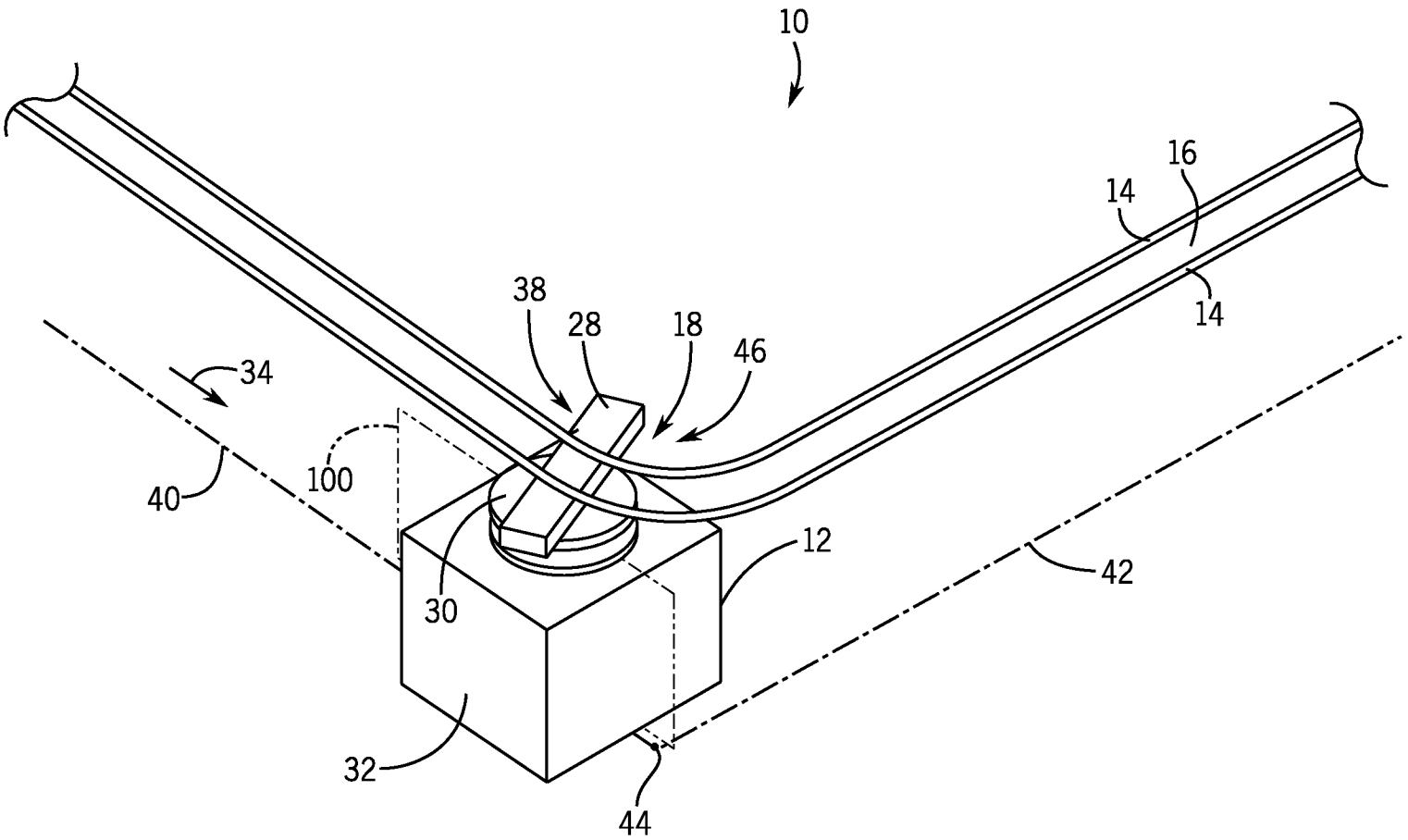
FIG. 14 is a perspective view of an embodiment of the ride vehicle of FIG. 13 as the ride vehicle reaches the bend in the first and second guide rails, in accordance with aspects of the present disclosure.

FIG. 14 is a perspective view of an embodiment of the ride vehicle system 10 as the ride vehicle 12 reaches the bend 38 in the guide rails 14. As the ride vehicle 12 continues and traverses the bends 38 in the guide rails 14 and the guide rails 14 diverge from a substantially parallel orientation with respect to the first line 40, the slider 28 extends toward the outside of the bend 38 and the rotator 30 rotates opposite the direction of the turn such that the central plane 100 of the cabin 32 is substantially aligned with the first line 40.

Figure 15:
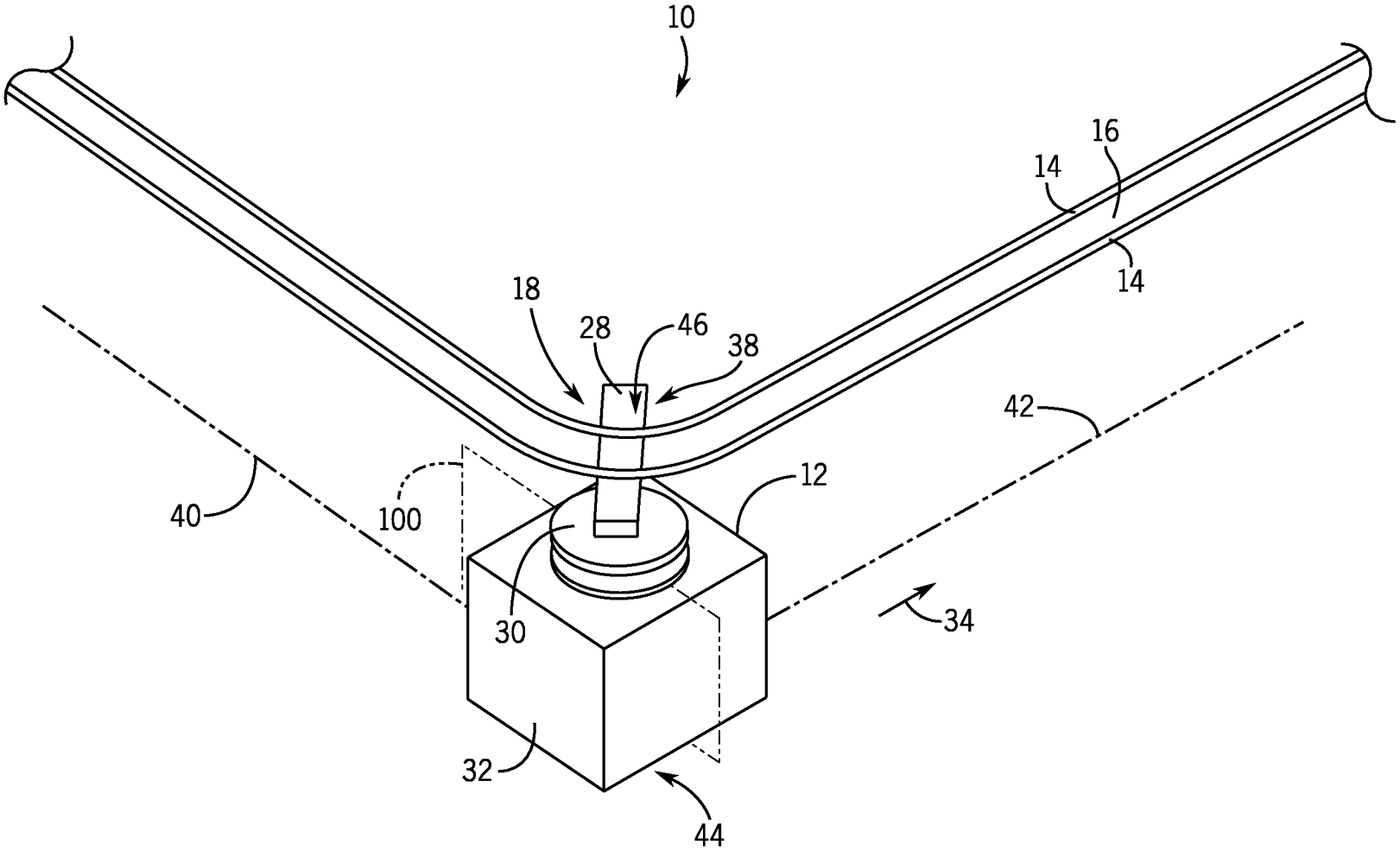
FIG. 15 is a perspective view of an embodiment of the ride vehicle of FIGS. 13 and 14 as the ride vehicle reaches an apex of the bend in the first and second guide rails, in accordance with aspects of the present disclosure.

FIG. 15 is a perspective view of an embodiment of the ride vehicle system 10 as the ride vehicle 12 reaches the apex 46 of the bend 38 in the guide rails 14. As shown, at the apex 46 of the bend 38, the slider 28 is extended toward the outside of the bend 38 and the rotator 30 is rotated such that the central plane 100 of the cabin 32 is substantially aligned with the first line 40. In some embodiments, upon reaching the apex 46, the rotator 30 may rotate such that the central plane 100 of the cabin 32 is substantially aligned with the second line 42. In other embodiments, the rotator 30 may not rotate and the cabin 32 may maintain its substantial alignment as the cabin 32 travels along the second line 42.

Figure 16:
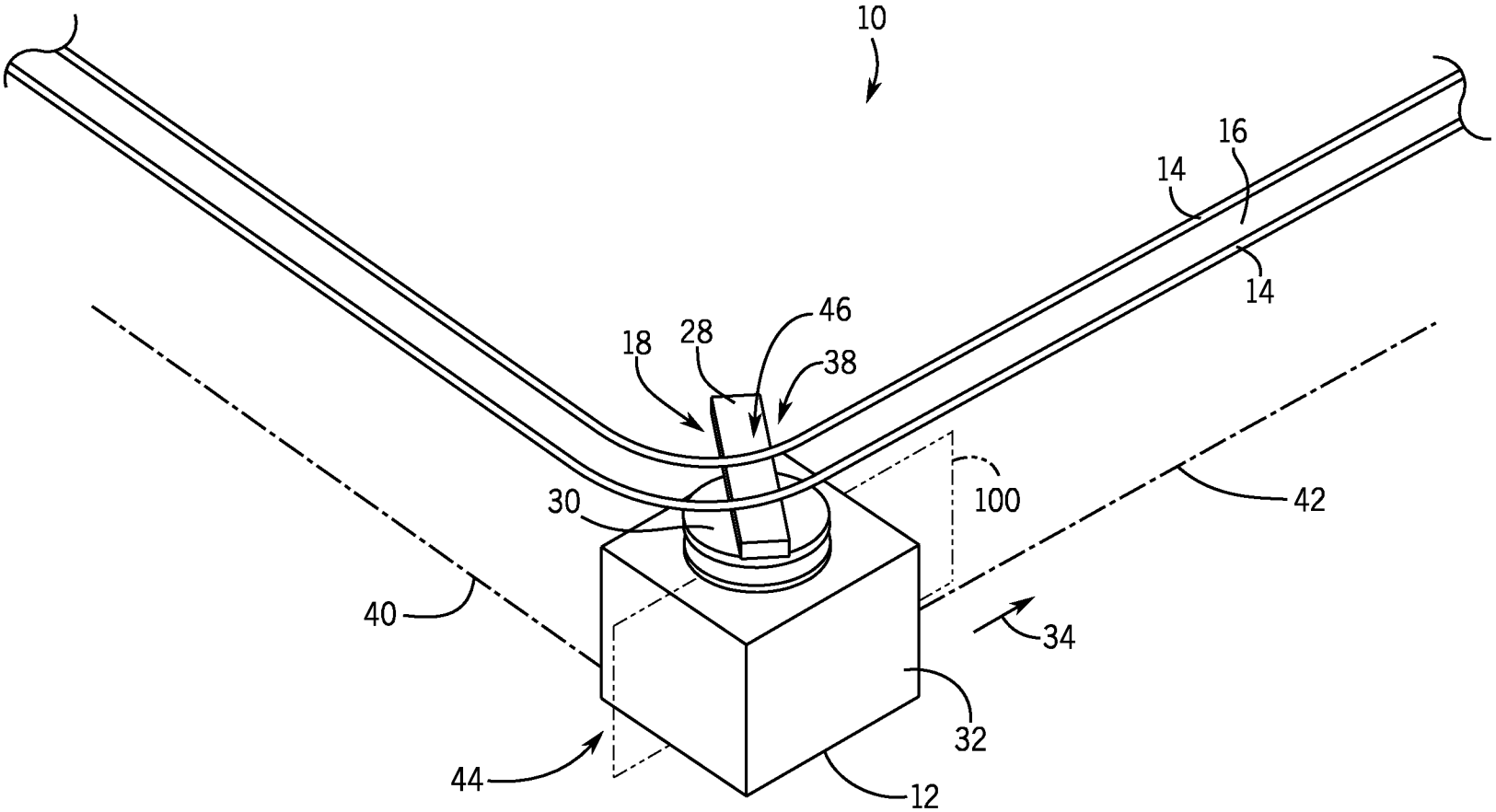
FIG. 16 is a perspective view of an embodiment of the ride vehicle of FIGS. 13-15 as the ride vehicle travels away from the apex of the bend in the first and second guide rails, in accordance with aspects of the present disclosure.

FIG. 16 is a perspective view of an embodiment of the ride vehicle system 10 as the ride vehicle 12 travels away from the apex 46 of the bend 38 in the guide rails 14. As the ride vehicle 12 proceeds along the guide rails 14, past the apex 46 of the bend 38, the rotator 30 rotates in the direction of the turn and the slider 28 contracts toward the inside of the bend 38, toward the neutral position, and such that the central plane 100 of the cabin 32 travels along the second line 42 away from the point 44 as the guide rails 14 converge with the second line 42.

Figure 17:
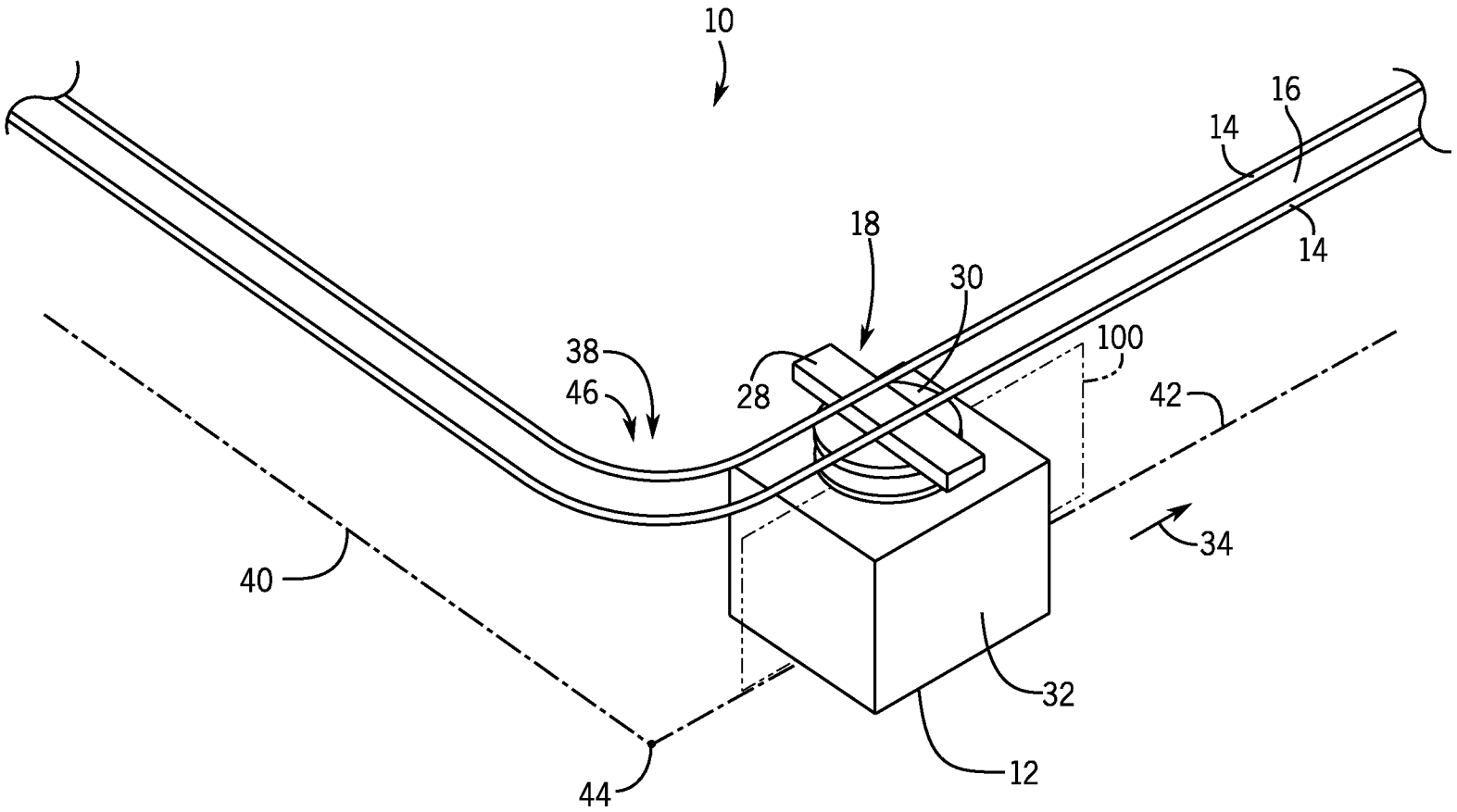
FIG. 17 is a perspective view of an embodiment of the ride vehicle of FIGS. 13-16 as the ride vehicle exits the bend in the first and second guide rails, in accordance with aspects of the present disclosure.

FIG. 17 is a perspective view of an embodiment of the ride vehicle system 10 as the ride vehicle 12 exits the bend 38 in the guide rails 14. As the ride vehicle 12 proceeds along the guide rails 14, past the bend 38, the slider 28 and the rotator 30 return to their respective neutral positions, such that the central plane 100 of the cabin 32 travels along the second line 42 away from the point 44.

It should be understood that, though FIGS. 1, 2, and 13-17 describe using the slider 28 and rotator 30 to simulate a sharp turn with the ride vehicle 12, that these techniques may be used to create other effects for the ride vehicle 12. For example, FIGS. 18 and 19 illustrate the ride vehicle 12 simulating a slalom motion while traveling along a straight ride path 16.

Figure 18:
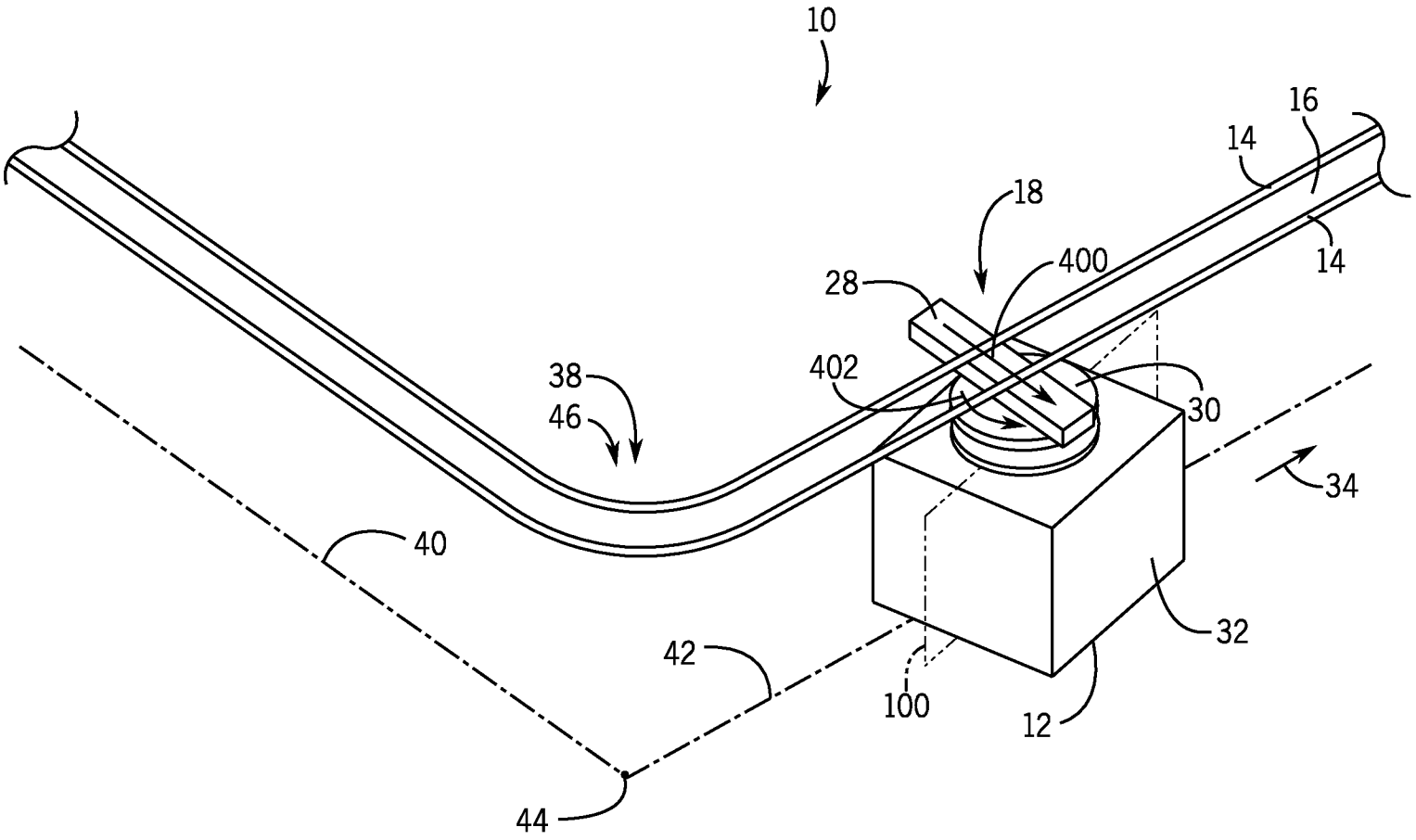
FIG. 18 is a perspective view of an embodiment of the ride vehicle of FIGS. 13-17 beginning to simulate a slalom motion, in accordance with aspects of the present disclosure.

FIG. 18 is a perspective view of an embodiment of the ride vehicle system 10 beginning to simulate the slalom motion. As shown, the slider 28 extends in a first linear or lateral direction 400 and the rotator 30 rotates in a second rotational direction 402 such that the central plane 100 of the cabin 32 is no longer substantially aligned with the second line 42. In some embodiments, the central plane 100 of the cabin 32 may be offset from and oblique to the second line 42. In other embodiments, the central plane 100 of the cabin 32 may be offset from, but substantially parallel to the second line 42. In further embodiments, the central plane 100 of the cabin 32 may be oblique to, but not offset from, the second line 42.

Figure 19:
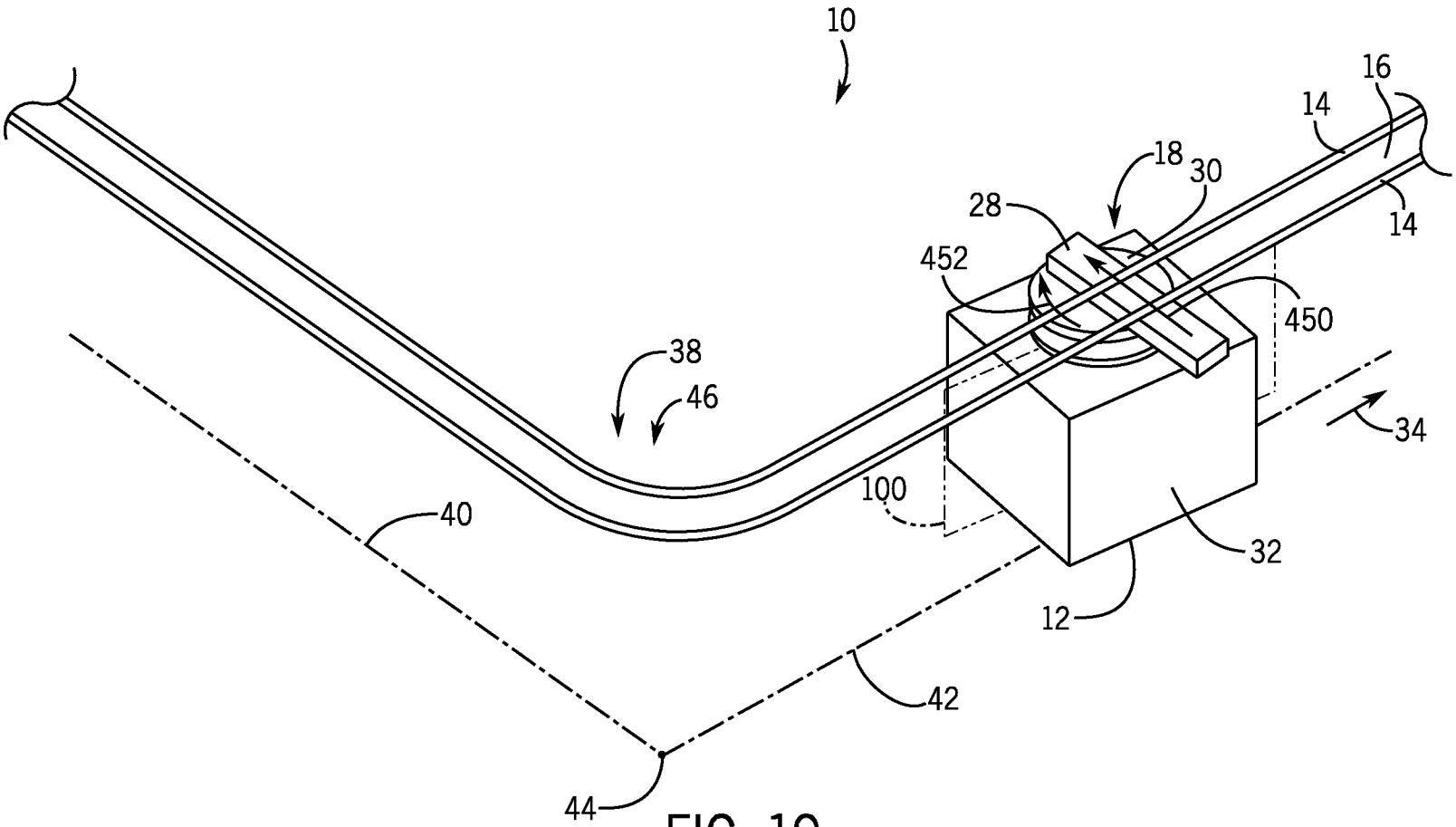
FIG. 19 is a perspective view of an embodiment of the ride vehicle of FIGS. 13-18 in the middle of simulating the slalom motion, in accordance with aspects of the present disclosure.

FIG. 19 is a perspective view of an embodiment of the ride vehicle system 10 in the middle of simulating the slalom motion. As shown, the slider 28 extends in a third direction linear or lateral 450, opposite the first linear or lateral direction 400. Correspondingly, the rotator 30 rotates in a fourth rotational direction 452, opposite the second rotational direction 402, such that the central plane 100 of the cabin 32 is no longer substantially aligned with the second line 42. In some embodiments, the central plane 100 of the cabin 32 may be offset from and oblique to the second line 42. In other embodiments, the central plane 100 of the cabin 32 may be offset from, but substantially parallel to the second line 42. In further embodiments, the central plane 100 of the cabin 32 may be oblique to, but not offset from, the second line 42. These motions (i.e., back and forth movement of the slider 28 and the rotator 30) may be strung together to create the effect of slaloming around and/or through an object or a series of objects, or moving the cabin 32 back and forth in open space.

These techniques may be used to create the effect that the ride vehicle 12 is quickly swerving (e.g., to avoid hitting one or more objects) or slaloming through multiple objects while the guide rails 14 remain straight. Similarly, the slider 28 and the rotator 30 disposed between the ride path 16 and the cabin 32 may be used to move the cabin 32 without the guide rails 14 being shaped to create these movements. Accordingly, using such a system, the ride system 10 may move the cabin 32 in ways that would be difficult or inefficient to achieve by merely following the one or more guide rails 14 that define the vehicle path. Though some movements of the cabin 32 may be possible to achieve by shaping the guide rails 14 appropriately (e.g., without the slider 28 and the rotator 30), manufacturing the guide rails 14 with the appropriate shapes may be difficult, expensive, and or inefficient. Accordingly, it may conserve resources to use straight guide rails 14 and achieve the desired motion of the cabin 32 using the slider 28 and the rotator 30.

The presently disclosed techniques include a ride vehicle having a cabin to house one or more guests, a chassis that couples to a guide rail, and a slider and rotator disposed between the chassis and the cabin. The slider moves the cabin back and forth in a lateral direction that is substantially transverse to the direction of travel along the guide rail. The rotator rotates the cabin relative to the chassis. The components may be used in concert to create effects that would be difficult, inefficient, or expensive to create with a ride vehicle that follows a ride path. For example, to simulate a sharp turn (e.g., a sharp 90 degree turn), the slider may extend from a neutral position toward the outside of the turn and the rotator may rotate from a neutral position toward the outside of the turn as the ride vehicle approaches the apex of the turn. As the ride vehicle passes through and departs the apex of the turn, the slider may retract back toward the neutral position and the rotator may rotate back toward the inside of the turn and toward the neutral position. However, the slider and rotator may be used individually or in concert to create other effects.

The word "substantially", as used herein (e.g., "substantially transverse", "substantially parallel", "substantially aligned", "substantially perpendicular", etc.) is intended to mean that two components may not be perfectly transverse, parallel, aligned, perpendicular, etc., but are sufficiently close enough to perfectly transverse, parallel, aligned, perpendicular, etc. that the operation of such components would not be noticeably different from components that are perfectly transverse, parallel, aligned, perpendicular, etc., as understood by a person of ordinary skill in the art. As such, the term "substantially" may allow for variance as large as of 0.01%, 0.1%, 1.0%, 2%, 3%, 4%, 5%, or some other value that would not noticeably change the operation of the components in question. However, it should be understood that mathematical terms (e.g., parallel), even without the use of terms like "substantially" as a modifier, would be interpreted in a practical manner within the field of this disclosure and not as rigid mathematical relationships.

While only certain features of the present disclosure have been illustrated and described herein, many modifications and changes will occur to those skilled in the art. It is, therefore, to be understood that the appended claims are intended to cover all such modifications and changes as fall within the true spirit of the disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. An amusement park ride vehicle, comprising:

a chassis configured to direct the ride vehicle along a ride path in a direction of travel;

a cabin configured to hold one or more passengers;

a slider configured to translate between a neutral position and a cantilevered position relative to the chassis in a direction substantially transverse to the direction of travel; and a rotator coupled between the slider and the cabin and comprising:

a first plate;

a second plate;

a bearing disposed between the first plate and the second plate to facilitate rotation of the first plate relative to the second plate; and at least one actuator configured to rotate the first plate relative to the second plate, wherein the rotator is configured to rotate the cabin relative to the slider and the slider is configured to carry the rotator and the cabin along the direction substantially transverse to the direction of travel.

2. The amusement park ride vehicle of claim 1, comprising a control system configured to output a first control signal to the slider to facilitate translation of the slider, and to output a second control signal to the rotator to facilitate rotation of the rotator.

3. The amusement park ride vehicle of claim 2, wherein the first control signal instructs the slider to translate in a first linear direction as the amusement park ride vehicle approaches a turn, wherein the first linear direction is toward an outside of the turn, and wherein the second control signal instructs the rotator to rotate in a first rotational direction as the amusement park ride vehicle approaches the turn, wherein the first rotational direction is opposite of a turn direction of the ride path.

4. The amusement park ride vehicle of claim 3, wherein the first control signal instructs the slider to translate in a second linear direction, opposite the first linear direction as the amusement park ride vehicle departs the turn, and wherein the second control signal instructs the rotator to rotate in a second rotational direction, opposite the first rotational direction as the amusement park ride vehicle departs the turn.

5. The amusement park ride vehicle of claim 1, wherein the slider comprises a counterweight configured to move opposite the cabin as the slider translates the cabin in the direction substantially transverse to the direction of travel.

6. The amusement park ride vehicle of claim 1, wherein the slider comprises a carriage configured to move along one or more tracks of the chassis.

7. The amusement park ride vehicle of claim 1, wherein the slider comprises a spring, a damper, or a combination thereof.

8. The amusement park ride vehicle of claim 1, comprising one or more pinch wheels configured to couple the chassis to a guide rail of the ride path.

9. The amusement park ride vehicle of claim 1, wherein the rotator comprises a motion base.

10. The amusement park ride vehicle of claim 1, comprising one or more drive wheels configured to provide a propulsive force for the chassis.

11. An amusement park ride system, comprising:

a guide rail defining a ride path, wherein the guide rail comprises a bend defining a turn; and a ride vehicle comprising:

a chassis configured to couple to the guide rail and to direct the ride vehicle along the guide rail in a direction of travel;

a slider configured to laterally translate in a direction substantially transverse to the direction of travel;

a cabin configured to house one or more guests; and a rotator coupled between the slider and the cabin, wherein the rotator is configured to rotate the cabin relative to the slider and the slider is configured to carry the rotator and the cabin along the direction substantially transverse to the direction of travel; and a control system configured to output a first control signal to the slider to facilitate translation of the slider, and to output a second control signal to the rotator to facilitate rotation of the rotator.

12. The amusement park ride system of claim 11, wherein the first control signal instructs the slider to translate in a first linear direction as the ride vehicle approaches a turn, wherein the first linear direction is toward an outside of the turn, and wherein the second control signal instructs the rotator to rotate in a first rotational direction as the ride vehicle approaches the turn, wherein the first rotational direction is opposite of a turn direction.

13. The amusement park ride system of claim 12, wherein the first control signal instructs the slider to translate in a second linear direction, opposite the first linear direction as the ride vehicle departs the turn, and wherein the second control signal instructs the rotator to rotate in a second rotational direction, opposite the first rotational direction as the ride vehicle departs the turn.

14. The amusement park ride system of claim 11, wherein the slider comprises a counterweight configured to move opposite the cabin as the slider laterally translates the cabin in the direction substantially transverse to the direction of travel.

15. The amusement park ride system of claim 11, wherein the slider comprises a carriage configured to move along one or more tracks of the chassis.

16. The amusement park ride system of claim 11, wherein the slider comprises a spring, a damper, or a combination thereof.

17. The amusement park ride system of claim 11, wherein the rotator comprises a motion base.

18. A method, comprising:

directing a ride vehicle along a guide rail defining a ride path in a direction of travel toward a turn;

actuating a slider to laterally actuate a cabin of the ride vehicle in a first linear direction substantially transverse to the direction of travel, from a neutral position toward a first side of the ride vehicle aligned with an outside of the turn;

actuating a rotator to rotate the cabin of the ride vehicle in a first rotational direction opposite of a turn direction, wherein the rotator is disposed between the cabin and the slider;

directing the ride vehicle along the guide rail in the direction of travel through the turn;

actuating the slider to laterally actuate the cabin of the ride vehicle in a second linear direction, opposite the first linear direction, toward a central plane of a chassis of the ride vehicle, returning the cabin to the neutral position; and actuating the rotator to rotate the cabin of the ride vehicle in a second rotational direction, opposite the first rotational direction.

* * * * *